US007827950B2

(12) United States Patent
Hu et al.

(10) Patent No.: US 7,827,950 B2
(45) Date of Patent: Nov. 9, 2010

(54) VALVE COVER ASSEMBLY AND METHOD OF CONSTRUCTION

(75) Inventors: Jake Hu, Skokie, IL (US); Daniele DeFranceschi, Windsor (CA); Tom Swasey, Okemos, MI (US); Jim Zwick, Brighton, MI (US)

(73) Assignee: Federal-Mogul Corporation, Southfield, MI (US)

( * ) Notice: Subject to any disclaimer, the term of this patent is extended or adjusted under 35 U.S.C. 154(b) by 309 days.

(21) Appl. No.: 12/146,685

(22) Filed: Jun. 26, 2008

(65) Prior Publication Data

US 2009/0044773 A1 Feb. 19, 2009

Related U.S. Application Data

(60) Provisional application No. 60/946,436, filed on Jun. 27, 2007.

(51) Int. Cl.
*F01M 9/10* (2006.01)

(52) U.S. Cl. ..... 123/90.38; 123/193.5; 277/596

(58) Field of Classification Search ..... 123/90.38, 123/193.3, 193.5, 195 C, 198 E, 198 F; 277/591, 277/596, 651, 652

See application file for complete search history.

(56) References Cited

U.S. PATENT DOCUMENTS

| | | | | |
|---|---|---|---|---|
| 3,692,335 | A | 9/1972 | Vickers et al. | |
| 3,773,142 | A | 11/1973 | Bragg et al. | |
| 4,244,438 | A | 1/1981 | Willmann | |
| 4,499,869 | A | 2/1985 | Visek | |
| 4,593,659 | A | 6/1986 | Wells et al. | |
| 4,719,892 | A | 1/1988 | Lopez-Crevillen | |
| 5,516,123 | A | 5/1996 | Eckel | |
| 6,382,158 | B1 | 5/2002 | Durnen | |
| 6,896,098 | B2 | 5/2005 | Vom Stein et al. | |
| 6,994,354 | B2 | 2/2006 | Sakata | |
| 7,316,214 | B2 * | 1/2008 | vom Stein | 123/90.37 |
| 2005/0193972 | A1 | 9/2005 | vom Stein | |
| 2005/0205033 | A1 | 9/2005 | vom Stein | |

FOREIGN PATENT DOCUMENTS

| | | |
|---|---|---|
| DE | 3701540 | 5/1988 |
| GB | 2328990 | 3/1999 |
| JP | 53115406 | 10/1978 |
| JP | 2006233856 A | 9/2006 |
| JP | 2006242000 A | 9/2006 |
| WO | WO01/27456 A1 | 4/2001 |

* cited by examiner

*Primary Examiner*—Ching Chang
(74) *Attorney, Agent, or Firm*—Robert L. Stearns; Dickinson Wright, PLLC

(57) ABSTRACT

A valve cover assembly for sealed engagement with a cylinder block includes a cover portion, a rail and a molded-in-place elastomeric bridge molded to the cover portion and the rail maintaining the cover portion and the rail in spaced relation to one another. The rail has an outwardly extending mounting flange providing a hard mounting bottom surface that is coplanar with the rail sealing surface. A seal depends from the sealing surface of the rail when in an uninstalled, uncompressed state for compression against the cylinder block upon the sealing surface and the hard mounting bottom surface being brought into engagement with the cylinder block, thereby establishing fluid-tight seal between the valve cover assembly and the cylinder block.

20 Claims, 4 Drawing Sheets

FIG - 1
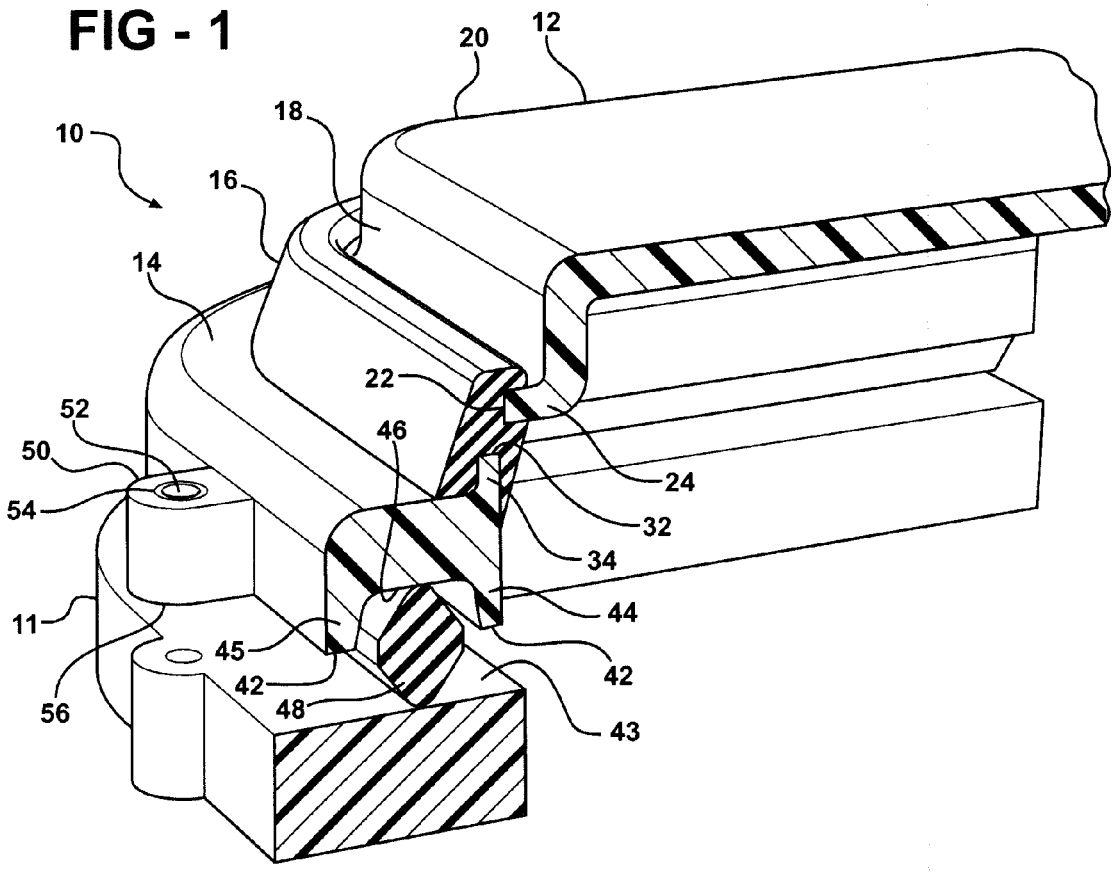
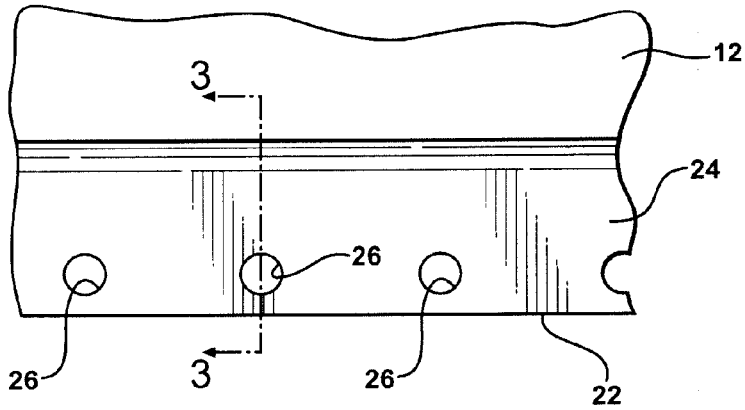
FIG - 2

FIG - 1A
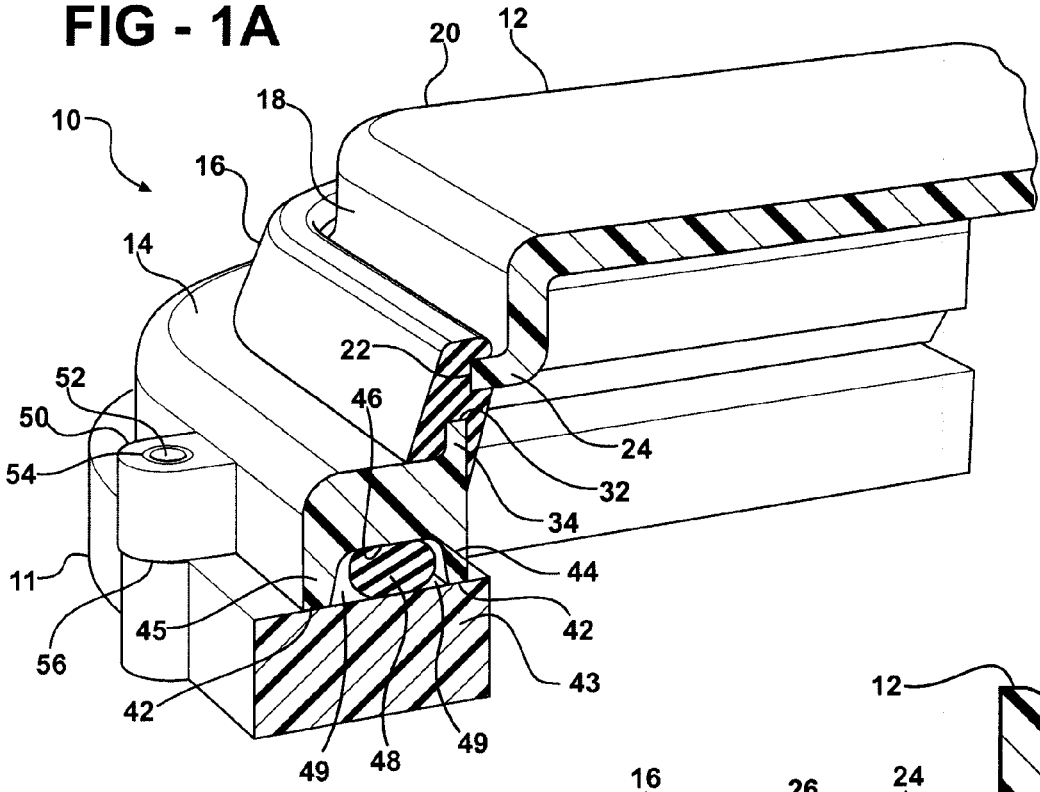
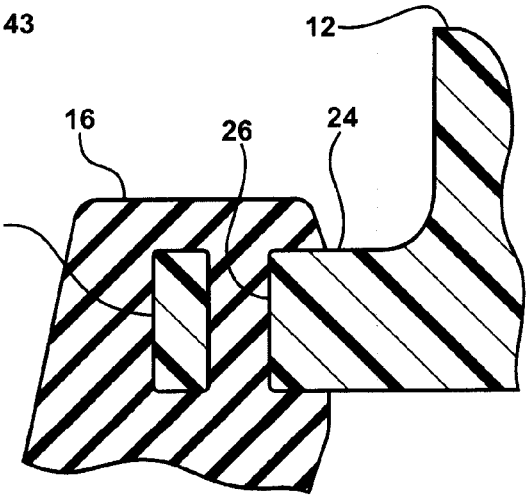
FIG - 3
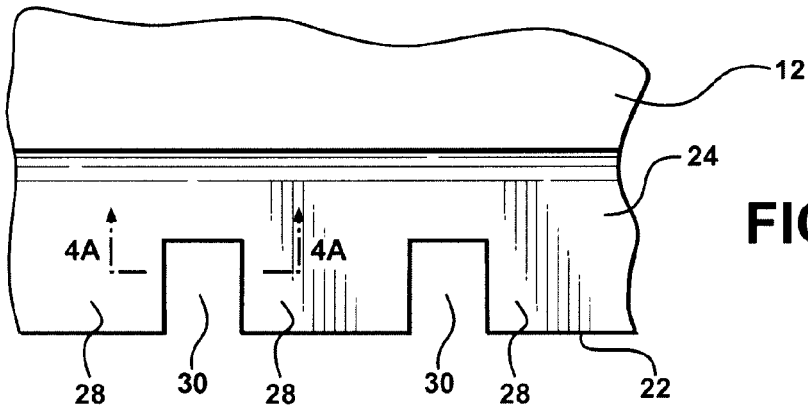
FIG - 4

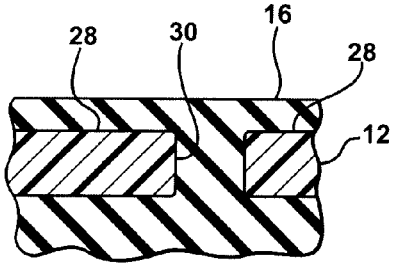
FIG - 4A
FIG - 5
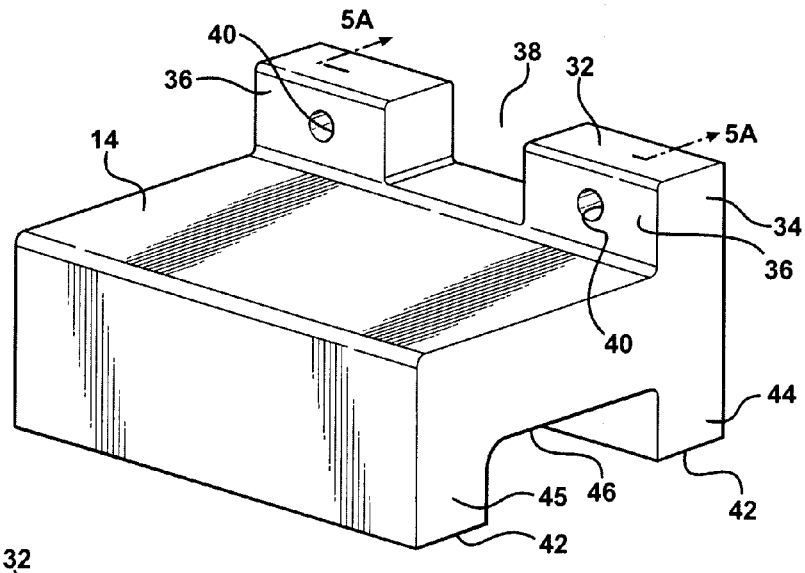
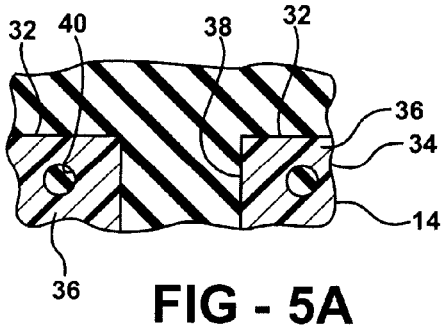
FIG - 5A
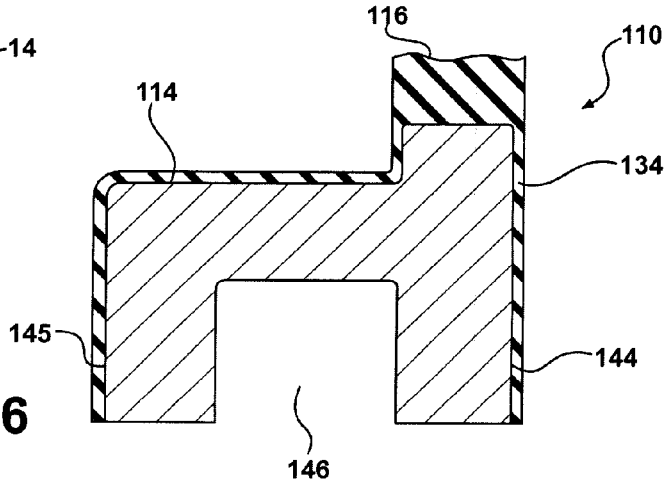
FIG - 6

VALVE COVER ASSEMBLY AND METHOD OF CONSTRUCTION

CROSS-REFERENCE TO RELATED APPLICATION

This application claims the benefit of U.S. Provisional Application Ser. No. 60/946,436, filed Jun. 27, 2007, which is incorporated herein by reference in its entirety.

BACKGROUND OF THE INVENTION

1. Field of the Invention

This invention relates generally to covers for internal combustion engines, and more particularly to valve covers attached to a cylinder head.

2. Related Art

Valve covers for automotive and other internal combustion engine applications typically are made of die cast metal, metal stampings or molded thick-walled thermoset or thermoplastics materials. The covers typically have a perimeter flange formed with a series of spaced bolt holes that enable the cover to be bolted onto an associated cylinder head of the engine. Relatively tall gaskets are typically disposed between the flange of the cover and the cylinder head, and upon fastening the cover to the head, the gasket is compressed to form a seal. As such, the valve cover essentially floats on the head with the gasket being sandwiched therebetween. In this type of sandwiched construction, after extended use, the bolts can become relatively loose, for example, due to temperature changes, vibration, and loading, and thus, leaks can result.

The all-metal valve covers are common, but are costly and heavy. The thick-walled all-plastic valve covers can be less costly and can contribute to a reduction in weight, but often the structural and dimensional stability requirements call for such large wall thicknesses that the benefits offered by the plastics material are offset by the bulkiness of the product and space requirements taken up by the added wall thickness. The all-plastic valve covers also require added fasteners as compared to the all-metal valve covers in order to adequately clamp the seal or gasket to prevent leakage. As such, the span between adjacent bolt holes decreases and the number of fasteners increases as compared to metal valve covers, adding to the cost and weight of the valve cover assembly. Further adding to the cost of all-plastic valve covers is the incorporation of bolt isolators to avoid over tightening of the bolts.

Another known problem commonly encountered with valve covers is the generation of noise, vibration and harshness (NVH). As such, there have been continual efforts made in attempts to reduce NVH of these covers. Some known practices include forming an elastomeric bridge between a cover portion and a flange portion of the cover, however, these efforts have resulted in relatively high cost products, both in manufacture and in service. As such, in addition to solving the NVH problems, there are also continual efforts being made to reduce costs associated with the manufacture of covers and in servicing covers upon use. Often, in service, the entire cover needs to be replaced, regardless of the problem, thereby passing on relatively high costs to the end user and possibly resulting in waste. For example, in one known construction, the elastomeric bridge is constructed as one piece of material with the seal, and thus, if the seal becomes defective, it becomes necessary to replace the entire cover.

SUMMARY OF THE INVENTION

A valve cover assembly for sealed engagement with a cylinder block includes a cover portion with a peripheral lip, a rail with an upwardly extending flange and a molded-in-place elastomeric bridge molded to the lip of the cover portion and to flange of the rail. The rail has a rigid sealing surface for establishing a fluid-tight seal in direct abutment against the cylinder block. The elastomeric bridge eliminates the generation and propagation of noise and vibration within the cover assembly. A recessed channel extends upwardly from the sealing surface of the rail for receipt of a seal provided as a separate piece of material from the elastomeric bridge. A mounting flange is spaced outwardly from the recessed channel. The mounting flange is substantially solid with a bolt opening extending therethrough. The mounting flange has a hard mounting bottom surface coplanar with the sealing surface of the rail. The seal depends from the sealing surface of the rail when in an uninstalled, uncompressed state for elastic compression against the cylinder block upon the sealing surface and the hard mounting bottom surface being brought into engagement with the cylinder block, thereby establishing a reliable, fluid-tight seal between the valve cover assembly and the cylinder block.

According to another aspect of the invention, a method of constructing a valve cover assembly is provided. The method includes molding a cover portion and a rail as a single piece of material with the cover portion being attached to the rail by frangible tabs. Further, disposing the single piece of material in a mold cavity and injecting an elastomeric material into the mold cavity and molding an elastomeric bridge connecting the cover to the rail in spaced relation from one another. Further, during the injection molding process, separating the frangible tabs from connecting the cover portion to the rail.

According to a further aspect of the method of construction, a step of forming a recessed channel in the rail can be provided. Additionally, a step of disposing a seal in the channel can be provided, wherein the seal can be provided as a press-in-place seal.

According to a further aspect of the method of construction, the seal can be provided as a different material from the bridge.

According to yet a further aspect of the method of construction, the recessed channel and the seal can be formed to provide an air space within the channel upon clamping the valve cover assembly against the cylinder block.

According to a further aspect of the method of construction, a step of forming the rail having hard mounting flanges extending laterally outwardly from the recessed channel at selected areas of the periphery of the rail can be provided. The mounting flanges can be formed as solid members of the rail material, with the exception of forming bolt openings extending therethrough. As such, the mounting flanges provide a clamping force in direct abutment against the cylinder block without deforming the rail while tightening the bolts.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 1 is a partial perspective cross-sectional view of a valve cover assembly constructed according to one presently preferred embodiment of the invention shown in a disassembled state above a cylinder block;

FIG. 1A is a view similar to FIG. 1 showing the valve cover assembled to the cylinder block;

FIG. 2 is a fragmentary plan view of a cover portion of the valve cover assembly according to one aspect of the invention;

FIG. 3 is a cross-sectional view taken generally along line 3-3 of FIG. 2 showing an elastomeric bridge attached to the cover portion;

FIG. 4 is a fragmentary plan view of a cover portion of the valve cover assembly according to another aspect of the invention;

FIG. 4A is a cross-sectional view taken generally along the line 4A-4A of FIG. 4;

FIG. 5 is a fragmentary perspective cross-sectional view of a rail of the valve cover assembly according to one aspect of the invention;

FIG. 5A is a cross-sectional view taken generally along the line 5A-5A of FIG. 5;

FIG. 6 is a partial cross-sectional view of a rail and bridge over-molded thereon according to another aspect of the invention;

DETAILED DESCRIPTION OF PRESENTLY PREFERRED EMBODIMENTS

Figure 7:
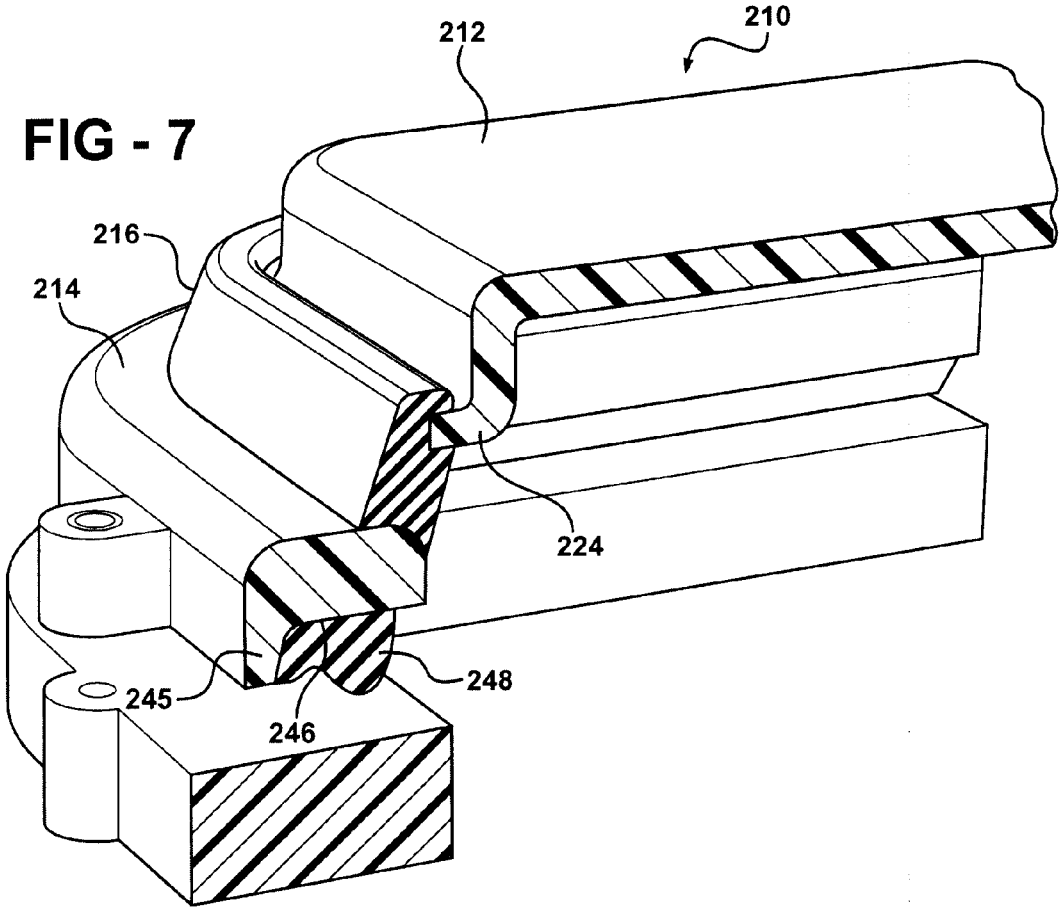
FIG. 7 is a partial perspective cross-sectional view of yet another valve cover assembly according to another aspect of the invention.

Referring in more detail to the drawings, FIGS. 1 (disassembled) and 1A (assembled) illustrate a valve cover assembly shown generally at 10 constructed according to one presently preferred embodiment of the invention for sealed engagement with a cylinder block 11. The valve cover assembly 10 has a cover portion 12 and a separate mounting flange or mounting rail, referred to hereafter as a rail 14, with the cover portion 12 and the rail 14 being connected to one another by a molded-in-place elastomeric bridge 16. The bridge 16 completely isolates the cover portion 12 from the rail 14 to inhibit NVH from being transmitted and/or generated in the valve cover assembly 10.

The cover portion 12 may be dome-shaped, and represented here, by way of example and without limitation, as being elongated to provide a generally trough-shaped structure. The cover portion 12 is preferably constructed from a moldable plastics material, including thermoplastics and thermosets. The cover portion 12 extends longitudinally between opposite ends 18 and laterally between opposite sides 20 that terminate at a free peripheral edge 22. In one presently preferred construction, the edge 22 extends laterally outwardly from the ends 18 and sides 20 to form an outwardly extending lip 24. The lip 24 may be peripherally continuous in shape, or otherwise constructed having recesses or through openings 26 (FIGS. 2 and 3) or outwardly extending projections or fingers 28 (FIG. 4) spaced laterally from one another by gaps 30 extending inwardly into the lip 24.

The rail 14, as represented in FIG. 5, can be constructed from a metal material, such as aluminum, for example, however, it could also be constructed from a rigid plastics material, if desired. The rail 14 is shown here, by way of example, and without limitations, as having an upwardly extending peripheral free edge 32 at the end of an upwardly extending peripheral flange 34. The flange 34 may be peripherally continuous in shape, without interruptions, or otherwise constructed having upwardly extending and laterally spaced fingers or projections 36 spaced from one another by gaps 38 and/or recesses. Further, the flange 34, and represented here, by way of example and without limitation, as the projections 36, can be formed having through openings 40.

The rail 14 has a lower sealing surface 42 depending from the peripheral flange 34 for establishing a hard mounted seal in direct engagement with a mounting surface 43 on the cylinder block 11. The sealing surface 42 is shown here as being formed at free ends of a pair of peripherally extending inner and outer legs 44, 45 spaced from one another by a generally U-shaped, recessed channel 46. The channel 46 extends upwardly into the flange 34 and is sized to receive a seal 48 therein, such that when the laterally spaced sealing surfaces 42 are brought into mating engagement with the cylinder block 11, the seal 48, as shown in FIG. 1A, is at least partially compressed elastically to form a fluid tight seal about the periphery of the rail 14. Accordingly, when in an uninstalled, uncompressed state, such as shown in FIG. 1, the seal 48 depends from the sealing surface 42. Further, upon being compressed, the seal 48 can be sized to provide a peripheral air pocket on one side of the seal 48 or air pockets 49 on opposite sides of the seal 48 within the channel 46 to enhance formation of a fluid tight seal. The seal 48 is preferably provided as a press-in-place seal, such that the seal 48 is fabricated separately from the rail 14. This allows the seal 48 to be readily replaced in service without having to replace the entire cover assembly 10.

The rail 14 has mounting flanges 50 extending laterally outwardly from the outer leg 45 at selected areas of the periphery of the rail 14. The mounting flanges 50 are preferably formed as solid, monolithic members of the rail material conjointly with the rail 14, with the exception of bolt openings 52 extending therethrough. As such, the mounting flanges 50 are able to provide suitable clamping force against the cylinder block 11 without concern of deforming the rail 14 while tightening the bolts (not shown). If desired, metallic compression inserts 54 can be disposed in the bolt openings 52 to further assure preventing deformation of the rail 14 during tightening. The bolt openings 52 extend through the thickness of the mounting flanges 50 in laterally spaced, outward relation to the channel 46, such that the openings 52 do not extend through the channel 46, and thus, are spaced away from and prevented from contacting the seal 48, thereby not affecting the sealing performance of the seal 48. In addition, the mounting flanges 50 have hard, rigid bottom mounting surfaces 56 that are brought into direct engagement with the cylinder head 11 upon tightening the bolts. As such, the mounting surfaces 56 are generally coplanar with the sealing surface 42 provided by the legs 44, 45. Accordingly, the seal 48 is assured of being compressed to the desired limit without being over or under compressed upon the bolts being tightened to a specified torque to bring the mounting surfaces 56 into clamped engagement with the cylinder head 11. Because the mounting flanges 50 are solid members, larger bolt spans (distance between adjacent bolts) are possible and thus the cover assembly 10 can be mounted with fewer fasteners than that required for traditional all-plastic covers. The cover assembly 10 also has improved dimensional stability and resistance to creep as compared to an all plastic cover of equivalent application. Further, given the abutment of the hard mounting surfaces 56 in direct contact with the hard cylinder block surface 43, the bolts fastening the valve cover assembly 10 to the cylinder block 11 are less prone to becoming loose than applications having a soft gasket layer therebetween.

The NVH bridge 16 is molded-in-place to connect the lip 24 of the cover portion 12 to the flange 34 of the rail 14. The bridge 16 maintains the cover portion 12 in spaced relation to the rail 14 to prevent the generation and/or transmission of vibration and noise. Wherein the rail 14 and the cover portion 12 are constructed as separate components from one another, the rail 14 and cover portion 12 are disposed individually into a mold cavity (not shown) of an injection mold machine. The manufacturing process continues by injecting elastomeric material, such as rubber, by way of example and with limitation, into the mold cavity to form the bridge 16, thereby coupling the cover portion 12 to the rail 14. Depending on the construction of the lip 24 and flange 34, as shown in FIGS. 3, 4A and 5A, the elastomeric material can either flow about the respective fingers 28, 36 and into the gaps 30, 38, whereupon the fingers 28, 36 become embedded within the bridge 16, and/or into the recesses or through the openings 26, 40 to form a mechanical lock between the bridge 16, the cover portion 12 and the rail 14, thereby permanently bonding and locking the bridge 16 to the cover portion 12 and the rail 14. To further facilitate chemically and mechanically bonding the bridge 16 to the cover portion 12 and the rail 14, the surfaces of the lip 24 and/or flange 34 can be roughened, such as in a molding, machining or chemical etching process, for example.

In FIG. 6, a portion of a valve cover assembly 110 constructed in accordance with another aspect of the invention is illustrated wherein reference numerals offset by a factor of 100 are used to identify similar features as described above. The assembly 110 has a cover portion (not shown) attached to a rail 114 via an elastomeric bridge 116. The rail 114 can be constructed generally the same as described above, and thus, it can have openings and/or fingers (not shown) in its flange 134, or the flange 134 and remaining outer surface of the rail 114 could have a roughened outer surface to facilitate bonding the elastomeric material of the bridge 116 thereto. Further, the rail 114 can be formed with legs 144, 145 laterally spaced from one another by a peripherally extending channel 146 for receipt of a press-in-place seal (not shown), as discussed above. However, in contrast to the embodiment above, the bridge 116 is over-molded onto the rail 114 to substantially cover the entire outer surface of the rail 114. As such, if the rail 114 is metallic, oxidation to the outer surface of the rail 114 is prevented.

Figure 8:
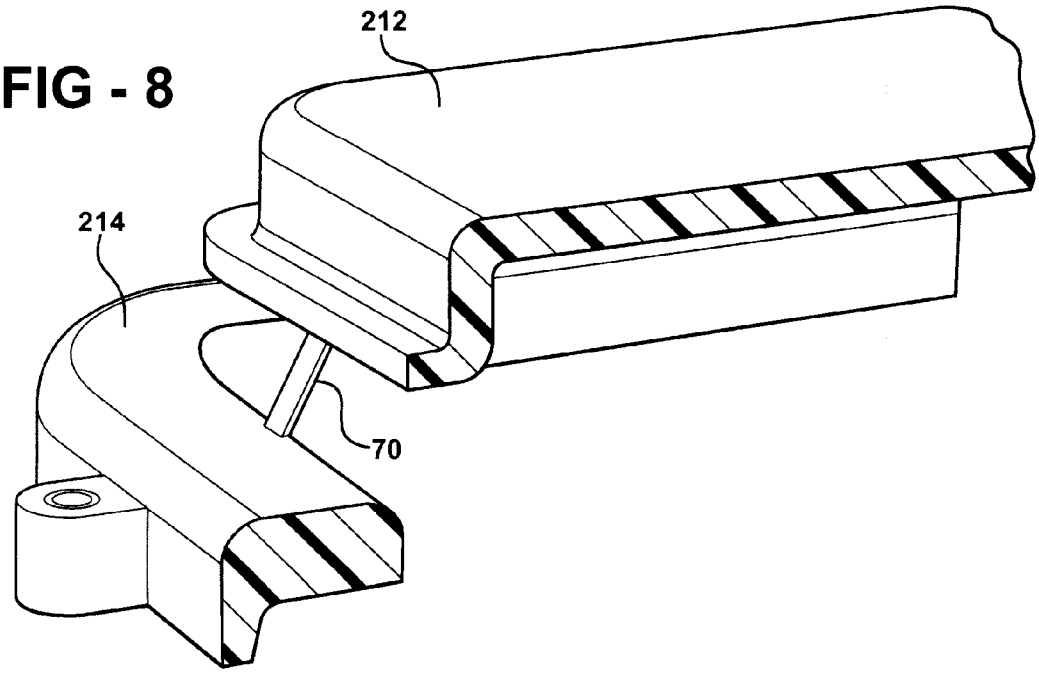
FIG. 8 is a partial perspective cross-sectional view of the valve cover assembly of FIG. 7 prior to having a bridge molded thereto.

In FIG. 7, a valve cover assembly 210 constructed in accordance with another aspect of the invention is illustrated wherein reference numerals offset by a factor of 200 are used to identify similar features as described in the first embodiment. The valve cover assembly 210 has a cover portion 212, a rail 214 and an elastomeric bridge 216 connecting the cover portion 212 to the rail 214. Unlike the embodiments above, however, the cover portion 212 and the rail 214 are both constructed from a plastics material. In one presently preferred construction, by way of example and without limitation, the cover portion 212 and the rail 214 are formed in a single molding process from the same plastics material as a monolithic piece of material being initially joined to one another by frangible tabs 70 (FIG. 8). The molded, one-piece cover-rail subassembly can then be transported and disposed into the mold cavity as one piece, thereby simplifying handling, and thus, the manufacturing process. When placed in the mold cavity, the manufacturing process continues by injecting elastomeric material into the mold cavity to form the bridge 216 between the lip 224 of the cover portion 212 and the rail 214. During the injection molding process, the frangible tabs 70 are broken and substantially dissipated, thereby causing the cover portion 212 to be completely separated from the rail 214, with exception to the connecting material of the elastomeric bridge 216.

In addition, during the molding process, a seal 248 can be molded within a channel 246 using the same elastomeric material as the bridge 216, or a different elastomeric material, as desired. The seal 248, although molded, can still remain separate and detached from the bridge 216. Otherwise, rather than molding the seal 248 in place, the seal 248 could be provided as a preformed seal and located within the channel 246 after molding the bridge 216. Although the channel 246 is represented here as being formed by a single outer leg 245, it could be molded having a pair of laterally spaced legs, as described above.

Obviously, many modifications and variations of the present invention are possible in light of the above teachings. It is, therefore, to be understood that within the scope of the appended claims, the invention may be practiced otherwise than as specifically described.

What is claimed is:

1. A valve cover assembly for sealed engagement with a cylinder block, comprising:

a cover portion having a peripheral lip;

a rail having an upwardly extending peripheral flange, a rigid sealing surface for engagement with the cylinder block depending from said flange, a recessed channel extending upwardly from said sealing surface, and a mounting flange spaced outwardly from said recessed channel, said mounting flange being substantially solid with a bolt opening extending therethrough and having a hard mounting bottom surface coplanar with said sealing surface;

a molded-in-place elastomeric bridge connecting said lip to said flange and maintaining said cover in spaced relation to said rail; and a seal disposed in said recessed channel as a separate piece of material from said molded-in-place elastomeric bridge, said seal depending from said rigid sealing surface when in an uninstalled, uncompressed state for compression against the cylinder block upon said sealing said rigid sealing surface and said hard mounting bottom surface being brought into engagement with the cylinder block.

2. The valve cover assembly of claim 1 wherein said recessed channel provides a peripheral inner leg and a peripheral outer leg, said inner and outer legs being spaced from one another by said recessed channel with each of said inner and outer legs providing said sealing surface.

3. The valve cover assembly of claim 2 wherein said mounting flange extends outwardly from said outer leg.

4. The valve cover assembly of claim 3 wherein said bolt opening is spaced outwardly from said recessed channel.

5. The valve cover assembly of claim 4 wherein said mounting flange has a mounting surface configured for engagement with the cylinder block, said mounting surface being coplanar with said sealing surface.

6. The valve cover assembly of claim 2 wherein an air pocket is provided between said seal and one of said legs upon said sealing surface and said hard mounting bottom surface being brought into engagement with the cylinder block.

7. The valve cover assembly of claim 6 wherein said air pocket is provided between said seal and both of said legs.

8. The valve cover assembly of claim 1 wherein one of said peripheral lip or said peripheral flange have through openings receiving said elastomeric bridge therethrough providing a mechanical lock between said elastomeric bridge and said one of said peripheral lip or said peripheral flange.

9. The valve cover assembly of claim 8 wherein one of said peripheral lip or said peripheral flange have outwardly extending projections spaced from one another by gaps, said projections being embedded within said elastomeric bridge and said elastomeric bridge being received in said gaps.

10. The valve cover assembly of claim 1 wherein said peripheral lip and said peripheral flange have through openings receiving said elastomeric bridge therethrough providing a mechanical lock between said elastomeric bridge and said peripheral lip, and between said elastomeric bridge and said peripheral flange.

11. The valve cover assembly of claim 10 wherein said peripheral lip and said peripheral flange have outwardly extending projections spaced from one another by gaps, said through openings extending through at least some of said projections, said projections being embedded within said elastomeric bridge and said elastomeric bridge being received in said gaps.

12. A method of constructing a valve cover assembly, comprising:

molding a cover portion and a rail having a sealing surface for establishing a fluid-tight seal against a cylinder block as a single piece of material;

disposing the single piece of material in a mold cavity; and injecting an elastomeric material into the mold cavity and forming an elastomeric bridge extending between the cover portion and the rail and separating the cover portion completely from the rail with the elastomeric bridge being bonded to the cover portion and the rail and maintaining the cover portion and the rail in spaced relation to one another as an assembly.

13. The method of claim 12 further including forming frangible tabs connecting the cover portion to the rail during the molding step.

14. The method of claim 13 further including disconnecting the frangible tabs from connecting the cover portion to the rail during the injecting step.

15. The method of claim 12 further including molding a channel extending upwardly into the sealing surface to provide laterally spaced legs during the molding step.

16. The method of claim 15 further including disposing a seal in the channel.

17. The method of claim 15 further including molding a plurality of mounting flanges having mounting surfaces extending outwardly from the channel, the mounting surfaces being coplanar with the sealing surface.

18. The method of claim 17 further including molding a peripheral flange extending upwardly from the sealing surface with openings extending through the peripheral flange and injecting the elastomeric material to flow through the openings to form a mechanical lock between the bridge and the rail.

19. The method of claim 18 further including molding a peripheral lip on the cover with a plurality of opening extending through the lip and injecting the elastomeric material to flow through the lip openings to form a mechanical lock between the bridge and the cover.

20. A valve cover assembly for sealed engagement with a cylinder block, comprising:

a dome shaped cover portion having a peripheral lip with a plurality of through openings;

a rail having an upwardly extending peripheral flange with a plurality of through openings, a rigid, substantially planar sealing surface depending from said flange for sealing engagement with the cylinder block, a recessed channel extending upwardly from said sealing surface, and a plurality of mounting flanges spaced outwardly from said recessed channel, said mounting flanges having bolt openings extending therethrough for receipt of bolts in outwardly spaced relation to said channel and having a rigid, substantially planar mounting bottom surface coplanar with said sealing surface;

an elastomeric bridge extending between said cover and said rail and maintaining said cover in spaced relation to said rail, said elastomeric bridge being molded through said openings in said lip and said flange to form a mechanical lock to said peripheral lip and said upwardly extending peripheral flange; and a seal disposed in said recessed channel as a separate piece of material from said elastomeric bridge, said seal depending from said rigid, substantially planar sealing surface when in an uninstalled, uncompressed state for compression against the cylinder block upon said rigid, substantially planar sealing surface and said mounting bottom surface being brought into engagement with the cylinder block.

* * * * *